United States Patent [19]

DiFazio

[11] 4,004,389

[45] Jan. 25, 1977

[54] GLAZING ADAPTOR

[75] Inventor: Joseph DiFazio, Troy, Mich.

[73] Assignee: Acorn Building Components, Inc., Detroit, Mich.

[22] Filed: Dec. 1, 1975

[21] Appl. No.: 636,534

Related U.S. Application Data

[63] Continuation-in-part of Ser. No. 607,142, Aug. 25, 1975.

[52] U.S. Cl. ..... 52/398; 52/616

[51] Int. Cl.[2] ..... E04B 1/62

[58] Field of Search ..... 52/398, 616, 203, 202

[56] References Cited

UNITED STATES PATENTS

| | | | |
|---|---|---|---|
| 3,442,059 | 5/1969 | Kessler | 52/616 X |
| 3,698,148 | 10/1972 | Marantier | 52/616 X |
| 3,875,706 | 4/1975 | Okawa | 52/616 X |
| 3,889,434 | 6/1975 | Shelver | 52/398 X |
| 3,928,953 | 12/1975 | Mazzoni et al. | 52/616 X |

*Primary Examiner*—Price C. Faw, Jr.
*Assistant Examiner*—Carl D. Friedman
*Attorney, Agent, or Firm*—Cullen, Settle, Sloman & Cantor

[57] ABSTRACT

A glazing adaptor for converting the effective width of the window panel receiving opening of a window frame from a first width to a second width, with the difference between the first and second widths exceeding the thickness of a pane of glass. The adaptor is a rigid unitary insulating structure including a first portion for frictional engagement with the window frame opening and a second portion to frictionally retain a window panel. Each of the adaptor portions includes flexible insulating barbs positioned for tight, water-resistant sealing with the window frame opening and the window panel, respectively. The second portion of the adaptor also includes resilient pads positioned to cushion the window panel.

9 Claims, 9 Drawing Figures

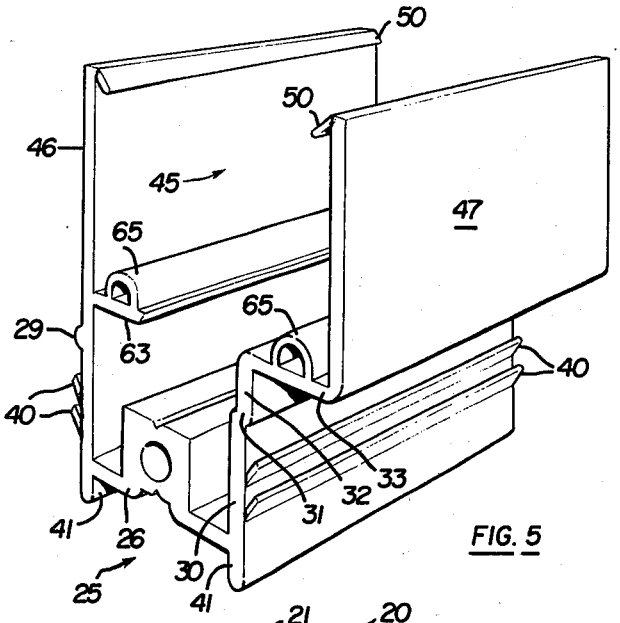
FIG. 5
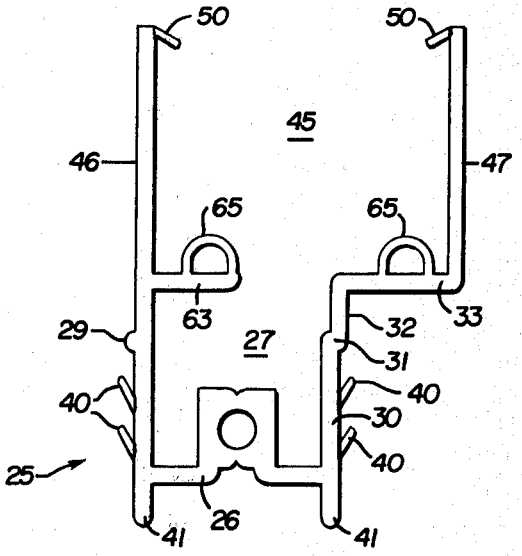
FIG. 6
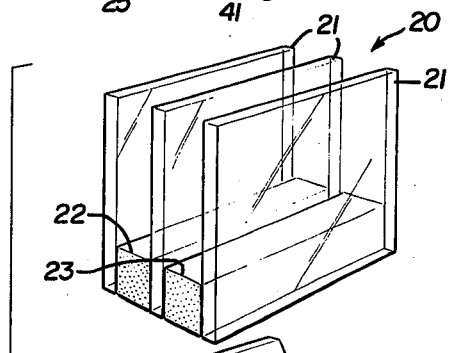
FIG. 7
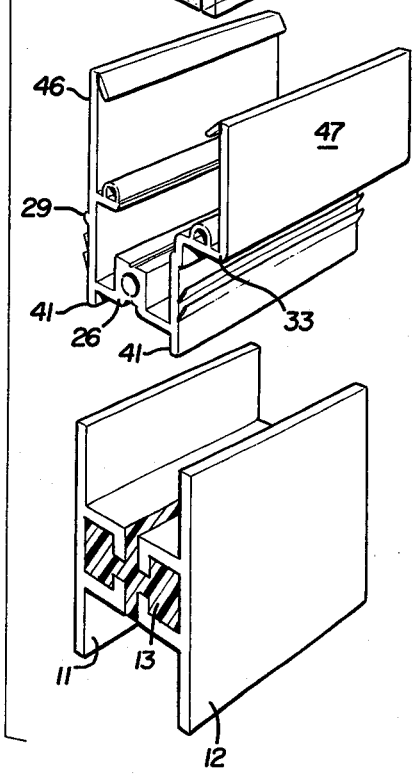
FIG. 8
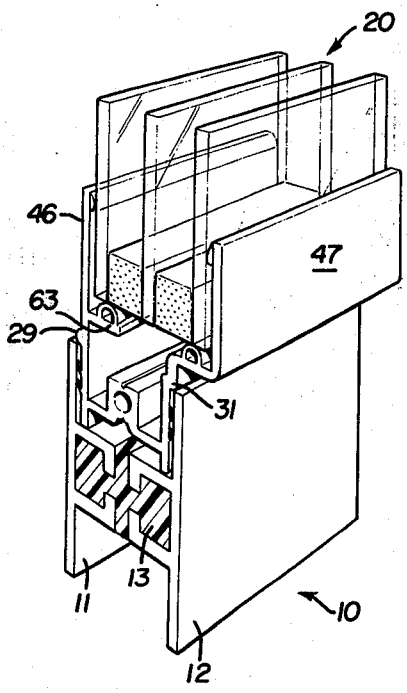
FIG. 9
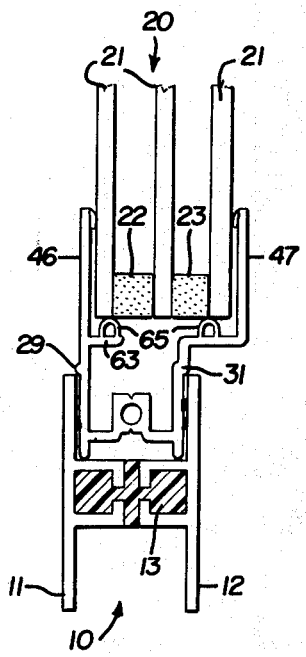

GLAZING ADAPTOR

CROSS-REFERENCE TO RELATED APPLICATION

This is a continuation-in-part of my copending application Ser. No. 607,142 filed Aug. 25, 1975, entitled GLAZING ADAPTOR and assigned to the assignee of the present invention.

BACKGROUND OF THE INVENTION

The invention herein relates to an improved adaptor for mounting an insulated glass panel within a frame such as the frame formed of extruded aluminum or the like. More specifically, the invention herein relates to an adaptor for converting the effective opening of a window frame component from a first width, such as the width of a double-glass insulated panel, to receive a panel of a different width such as a triple-insulated glass panel.

In the fabrication of thermally insulated glazed window and door panels, it is conventional to form an extruded metal frame having two metal frame members thermally insulated from each other. A glass panel having two panes of glass thermally insulated from each other by a sealing spacer is inserted into the frame.

In the use of window panels and door panels of the type just described, a certain amount of heat loss through the double-thickness insulated glass is, of course, expected. It is known that heat loss may be significantly reduced by using a triple sealed insulated glass. That is, the use of three individual panes of glass with a sealing spacer between the first and second pane and another sealing spacer between the second and third pane.

For each window and door, each manufacturer designs aluminum extrusions of specific cross-sections with only the frame opening being standard to receive a double-pane insulated panel. Hence, to also provide extrusions with an opening to receive a triple pane insulated panel would require a double inventory for each manufacturer and distributor. Furthermore, each manufacturer would have to double the number of costly aluminum extrusion dies. Then, there is the cost of the extra aluminum for the larger opening frames. Thus, it was not economical to manufacture and stock frames with triple-panel openings as well as frames with double-panel openings prior to the present invention.

Hence, the invention herein relates to a standard or universal glazing adaptor to modify the effective frame opening from double-panel width to triple-panel width. Specifically, the invention relates to an adaptor having a first portion to be inserted in a window or door frame opening of a size to accommodate a sealed double-pane glazed panel, and a second portion which provides an opening of a size to receive a sealed triple-pane glazed panel. The adaptor is a unitary structure of a low cost insulating material and has sufficient flexibility to accommodate normal variations in sizes among triple-pane glazed window panels. The adaptor also includes a plurality of cushioning pads to protect the triple-pane glazed panel from shock and breakage which can occur during opening and closing of sliding glass doors and windows.

SUMMARY OF INVENTION

The invention herein contemplates a universal glazing adaptor for converting a frame opening from a first width to receive a glazed panel of a second width with the difference between the first and second widths exceeding the thickness of a pane of glass. The adaptor, which is preferably formed of a substantially rigid insulating plastic, includes a first portion for frictional engagement with the frame opening and a second portion to frictionally receive and retain the glazed panel. The second portion of the adaptor is slightly flexible to accommodate glazed panels of slightly varying widths. Each of the adaptor portions includes flexible insulating barbs positioned for tight water-resistant sealing of the adaptor to the frame and to the glazed panel, respectively. The second portion of the adaptor also includes resilient pads positioned to cushion the glazed panel from shock.

In the preferred embodiment the adaptor is channel shaped and after the glazed panel is inserted into the second portion of the adaptor, insertion of the first portion of the adaptor into the frame opening serves to increase the frictional fit between the glazed panel and the adaptor second portion.

The various objects and advantages of the present invention will become apparent upon reading the following detailed description taken in conjunction with the drawings.

BRIEF DESCRIPTION OF DRAWINGS

In the drawings, where like references numerals identify corresponding components:

FIG. 5 is a perspective illustration of a preferred form of glazing adaptor;

FIG. 6 is an end view of the preferred glazing adaptor of FIG. 5;

FIG. 7 is an exploded perspective view of a window frame used with the glazing adaptor of FIG. 5 to receive a triple-glazed panel;

FIG. 8 is a perspective view of an assembled window frame, glazing adaptor and triple-glazed panel unit of FIG. 7; and FIG. 9 is an end view of the assembled window frame, adaptor and glazed panel of FIG. 8.

DETAILED DESCRIPTION OF THE INVENTION

Figure 1:
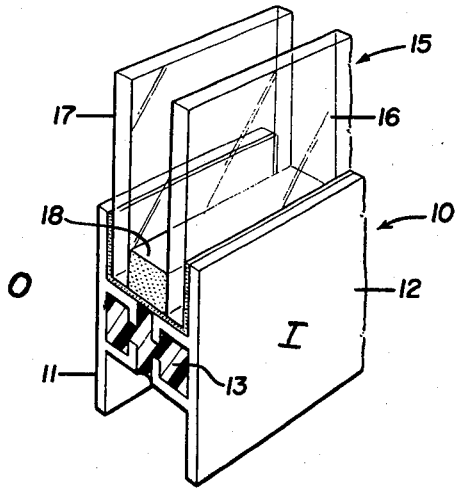
FIG. 1 is a perspective illustration of a thermally-insulated window frame and a double-thickness thermally insulated glass panel inserted therein.

FIG. 1 illustrates a perspective view of a window or door frame 10 including a pair of opposed, spaced apart aluminum extrusions 11, 12 which are maintained in rigid spaced apart relationship by an insulating material 13 such as a polyurethene.

Inserted in the window frame 10 is a double-glass or double-pane window panel 15 comprising two panes of glass 16, 17 maintained in a spaced apart relationship by an insulated sealing strip 18. Constructions such as those shown in FIG. 1 are old. A gasket 19 may be placed between the window panel and the frame.

Figure 3:
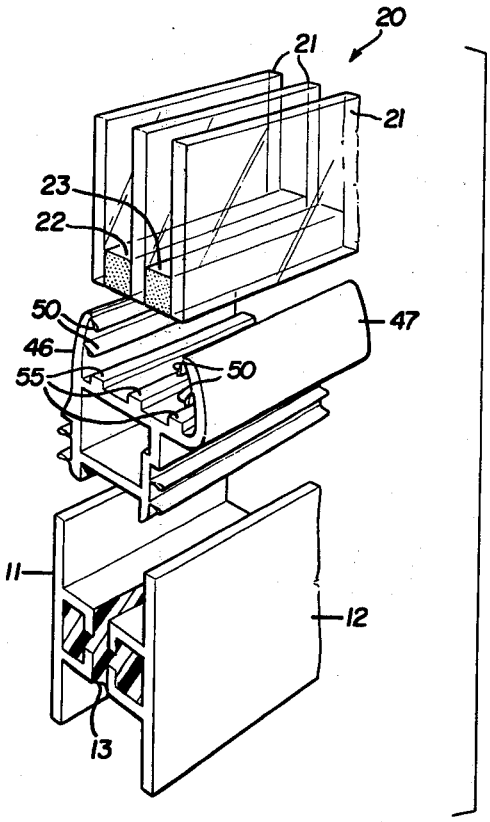
FIG. 3 is an exploded perspective view of a window frame, as used with a glazing adaptor to receive a triple glazed panel.

In order to increase the thermal-insulating quality of the window between the inside I, and the outside O, it has been known to utilize a triple-glass panel 20, as illustrated in FIG. 3. A triple-glass panel includes three parallel panes of glass 21, with the first and second pane maintained in a spaced apart thermally insulated relationship by a sealing strip 22 and the second and third pane maintained in a spaced apart thermally insulated relationship by a sealing strip 23. Triple-glass panels are also well known and serve to increase the thermal-insulating capabilities of the window between the outside, O, and inside, I, of the window.

Hence, the present invention contemplates the use of a universal adaptor 25 to modify the effective opening between the frame members 11 and 12 of the window frame 10 to receive a triple-glass panel 20.

The adaptor 25 is a unitary structure of a substantially rigid insulating material such as vinyl. In a first embodiment, FIGS. 2, 3 and 4, the adaptor includes a base 26 and a first portion 27 depending downwardly therefrom. The first portion 27 includes a first downwardly depending leg 28 having an external shoulder 29 and a second downwardly depending leg 30 spaced apart from leg 28. Leg 30 is recessed to provide an inwardly extending shoulder as at 31 and then continues in a downwardly extending leg portion 32. A cross support 35 joins leg 28 to the portion 32 of the leg 30. The shoulders 29 and 31 limit the depth of insertion of the adaptor into the frame 10.

Figure 2:
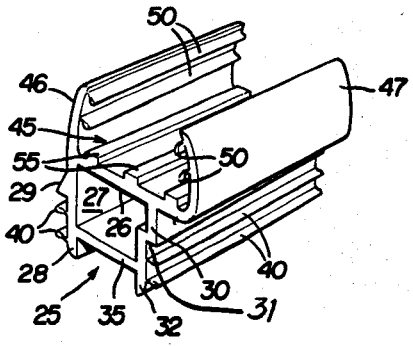
FIG. 2 is a perspective view of the glazing adaptor of the present invention for permitting the utilization of a triple-pane thermally insulated glass panel in the same double-width frame extrusion of FIG. 1.
Figure 4:
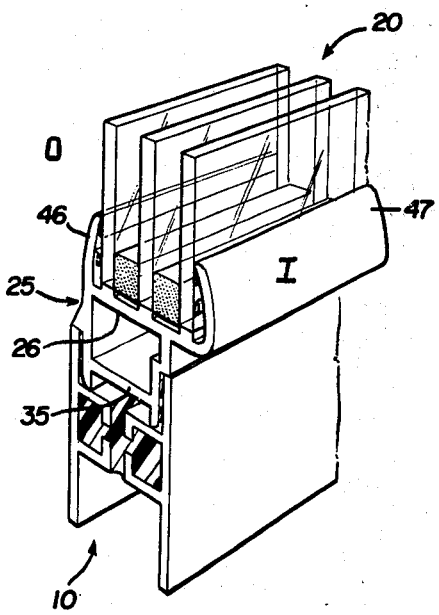
FIG. 4 is a perspective view of an assembled window frame, glazing adaptor and triple-glazed panel unit.

As illustrated in greater detail in FIGS. 2, 3 and 4, the first portion 27 of the adaptor 25 includes four upwardly angled elongated barbs or seals 40 of a flexible vinyl material. These seals are provided externally of the legs 28 and 30 to provide a tight water-resistant fit between the first portion 27 of the adaptor 25 and the opening in the window frame 10.

The adaptor 25 also includes a second portion 45 including first and second spaced apart legs 46, 47 extending upwardly from the base 26 with leg 46 being a continuation of leg 28 and with leg 47 being spaced outwardly beyond leg 30. Legs 46 and 47 taper gradually toward each other as they extend away from the base 26. Four downwardly angled vinyl seals or barbs 50 in the form of elongated strips of flexible vinyl are positioned interiorly of the second portion 45 of the adaptor with two such seals on the interior wall of each leg 46, 47. These seals provide a tight water-resistant fit between the adaptor 25 and the triple-glass panel 20.

The slight inward taper of the legs 46, 47 provides sufficient flexibility in the second portion 45 of the adaptor 25 to accommodate triple-glass panels of slightly varying widths.

At the top of the base 26, as illustrated in FIGS 2, 3 and 4, i.e., at the second portion of the adaptor, there are three parallel elongated resilient vinyl pads 55. These pads are positioned so that upon insertion of the triple-glass panel 20, each pane of glass 21 rests on a vinyl pad 55. This provides a cushioning for each of the panes of glass during transit and during movement of the glass panel if it is in a sliding patio door or window, etc. These pads provide a cushion and absorb shock imparted to the glass panel, thereby substantially eliminating breakage of the glass.

FIGS. 5 through 9 illustrate a preferred form of adaptor 25 which is channel or U-shaped or cantilevered and made of rigid vinyl. The adaptor again includes a base 26, a first portion 27 to fit within the window frame 10 and a second portion 45 to receive the triple-glazed panel 20. The first portion 27 includes two legs 28, 30 which extend upwardly from the base 26. Leg 28 includes an external shoulder or projection 29. Leg 30 flares outwardly as at 31 to provide a shoulder, then continues upwardly as at extension 32. Shoulders 29 and 31 again limit the depth of insertion of the adaptor into the frame.

The second portion 45 of the adaptor is a continuation or extension of the first portion 27. Leg 28 continues upwardly as at 46 and has an inwardly projecting flange 63. Leg 30 continues outwardly at extension 33, which is at the same height as flange 63 and then leg 30 bends upwardly to form leg 47.

As the embodiment of FIGS. 2, 3 and 4, in preferred embodiment, the first portion 27 includes four upwardly angled elongated barbs or seals 40 of flexible vinyl provided externally of legs 28 and 30 and two barbs 41 at the bottom of the legs, all to provide the tight water-resistant fit between the first portion of the adaptor 27 and the window frame. In this embodiment only two barbs 50 are provided to seal the second portion 45 of the adaptor to the glazed panel.

To cushion the glazed panel, two hollow barbs 65 of flexible material are provided on the second portion 45 of the adaptor, on one top of flange 63 and one above the outward portion 33 of leg 30.

In the preferred embodiment, once a glazed panel 20 is inserted in the second portion 45, when the first portion 27 is placed in a frame 10, the pressure of frame 10 on legs 28 and 30, by virtue of the channel or cantilever structure, tightens the fit of the second portion legs 46 and 47 against the glazed panel 20. Thus a tight fit at the frame serves to tighten the fit at the panel.

A block 70 on the base 26, apertured as at 71, functions as a screw boss so that two adaptors positioned on adjacent edges at a corner of a glazed panel, may be securely held together by a screw (not shown). In such a construction a hole is drilled through base 26 of one adaptor, at one end thereof, and a screw inserted therethrough and then into aperture 71 of the screw boss or block 70 of the adjacent adaptor.

In each embodiment the adaptor 25 is manufactured by a double-extrusion process. A first vinyl is fed through an extruder and emerges in the configuration of the adaptor 25 except for the seals 40, 41, 50 and either pads 55 or barbs 65. The adaptor so formed of rigid vinyl is then passed through a second extruder at which time a different vinyl plastic, i.e., a flexible vinyl platic, is extruded onto the adaptor to provide the various seals, and pads and bars.

Thus, it may be seen that each adaptor of the present invention modifies an effective opening of a window frame to accommodate a glass panel of a substantially different size. The plastic is a natural insulator and is less costly than aluminum. Furthermore, the cost of the extrusion dies are much less for plastic than for aluminum. Finally, since the opening between frame members 11 and 12 is standard for double-pane glazed panels, either embodiment of adaptor 25 may be used to convert substantially all cross-sectional configurations of frames 10 to receive triple-pane glazed panels.

It must be appreciated that various modifications may be made without departing from the spirit and scope of the present invention. Thus, while the present invention has been shown in the context of an adaptor for converting an opening for a double-glass panel into an opening for a triple-glass panel, adaptors may be utilized to convert the effective opening of an extrusion to accommodate virtually any number of parallel glass panels. In fact, a non-insulated single pane metal extrusion frame may be modified by the use of an adaptor of the present invention to receive double-panel insulated glass.

Similarly, by reversing the relative sizes of the first portion 27 and the second portion 45 of either adaptor so that the first portion 27 is wider than the second portion, the adaptor of the present invention may be utilized to reduce the effective opening of a window frame extrusion, such as where it has been decided that while the frame is thermally insulated, only a single-glass panel is desired. This may be accomplished by merely reducing the effective width of the second portion 45 of the adaptor 25 relative to the first portion 27.

Hence, the present invention should not be construed in a restrictive sense, but should be limited only by the spirit and scope of the following claims.

What is claimed is:

1. In combination with a window frame having a frame opening of a first width, the improvement of a universal glazing adaptor to be inserted into said frame opening said first width to receive a double-pane thermally sealed glass panel or the like, said adaptor for receiving a triple-pane-thermally sealed glass panel or the like, comprising:

a rigid frame-engaging portion of double-pane width insulating material for insertion into said frame opening at least part of said frame engaging portion being wider than said first width; and a rigid receptacle portion of triple-pane width insulating material, integral with and extending upwardly from said frame-engaging portion for receiving and frictionally retaining a triple-pane-thermally sealed glass panel;

said adaptor including a base at one end of said frame-engaging portion so that said adaptor is U-shaped in cross section, whereby when said glass panel is inserted in said receptacle portion and thereafter said frame engaging portion inserted into said frame, the frictional fit between said frame and said frame-engaging portion tightens the frictional fit between said glass panel and said receptacle portion.

2. The invention as defined in claim 1, wherein said frame-engaging portion includes shoulders for limiting the extent of insertion of the frame-engaging portion into said frame opening and external resilient sealing members for providing a water-resistant seal between said frame-engaging portion and said frame opening.

3. The invention as defined in claim 1, wherein said rigid receptacle portion of said adaptor includes a pair of parallel spaced apart legs of limited resiliency to accommodate triple panes of slightly varying widths and means to cushion said panes from said adaptor.

4. In combination with a window frame having a frame opening of a first thickness, the improvement of a glazing adaptor for modifying the effective width of said frame opening from said first thickness to a second thickness with the difference between said first and second thickness exceeding the thickness of a pane of glass, comprising:

a frame-engaging portion formed of relatively rigid insulating material and having first and second spaced apart parallel legs, at least a part of same frame engaging portion being wider than said first thickness; and a glass panel receptacle portion formed of an insulating material and formed integrally with said frame-engaging portion, said receptacle portion including a first and second substantially rigid spaced apart legs having slight flexibility to accommodate the insertion of a glass panel; said first leg being an extension of the first leg of said frame-engaging portion;

said adaptor including a flat base formed integrally with one end of said frame-engaging portion, to form an adaptor of generally U-shaped cross section with said receptacle portion being an extension of said frame engaging portion so that a tight fit between said frame-engaging portion and a frame increases the frictional fit between the receptacle portion and a glass panel; and whereby upon insertion of the frame-engaging portion into a frame opening, the receptacle portion provides an effective glass panel opening.

5. The invention as defined in claim 4, wherein each of said first and second legs in said frame-engaging portion includes a shoulder to limit the extent of insertion of said frame-engaging portion into a frame opening.

6. The invention as defined in claim 4, wherein said first and second legs of said frame-engaging portion each include flexible resilient sealing strips positioned externally thereof to provide a water-tight seal between said legs and a frame when said adaptor is inserted in said frame.

7. The invention as defined in claim 4, wherein each of said legs of said receptacle portion include flexible, resilient sealing strips projecting inwardly thereof to provide a tight water-resistant seal between said receptacle portion and a glass panel.

8. The invention as defined in claim 4, wherein said receptacle portion includes discrete flexible resilient barbs to cushion the glass panel from said adaptor.

9. The invention as defined in claim 6, wherein the first and second legs of said receptacle portion taper slightly toward each other.

* * * * *